US007146965B1

(12) United States Patent
Li et al.

(10) Patent No.: US 7,146,965 B1
(45) Date of Patent: Dec. 12, 2006

(54) ENHANCED FUEL PRESSURE PULSATION DAMPING SYSTEM WITH LOW FLOW RESTRICTION

(75) Inventors: Joe Z. Li, Northville, MI (US); Christopher J. Treusch, St. Clair Shores, MI (US); Christopher H. Price, Saline, MI (US)

(73) Assignee: Automotive Components Holdings, LLC, Dearborn, MI (US)

( * ) Notice: Subject to any disclaimer, the term of this patent is extended or adjusted under 35 U.S.C. 154(b) by 78 days.

(21) Appl. No.: 11/141,726

(22) Filed: May 31, 2005

(51) Int. Cl.
*F02M 55/02* (2006.01)

(52) U.S. Cl. ..... 123/456; 123/468; 123/467

(58) Field of Classification Search ..... 123/456, 123/468, 469, 467
See application file for complete search history.

(56) References Cited

U.S. PATENT DOCUMENTS

| | | | | |
|---|---|---|---|---|
| 4,586,477 | A | 5/1986 | Field et al. | |
| 4,600,076 | A | 7/1986 | Yamamoto et al. | |
| 5,056,489 | A | 10/1991 | Lorraine | |
| 5,390,638 | A | 2/1995 | Hornby et al. | |
| 5,435,699 | A | 7/1995 | Thawani et al. | |
| 5,445,130 | A | 8/1995 | Brummer et al. | |
| 5,511,527 | A * | 4/1996 | Lorraine et al. | 123/456 |
| 5,516,266 | A | 5/1996 | Talaski | |
| 5,535,717 | A | 7/1996 | Rygiel | |
| 5,617,827 | A | 4/1997 | Eshleman et al. | |
| 5,752,486 | A * | 5/1998 | Nakashima et al. | 123/467 |
| 5,845,621 | A | 12/1998 | Robinson et al. | |
| 5,896,843 | A | 4/1999 | Lorraine | |
| 5,954,031 | A | 9/1999 | Ogiso et al. | |
| 6,314,942 | B1 | 11/2001 | Kilgore et al. | |
| 6,401,691 | B1 | 6/2002 | Kawano et al. | |
| 6,463,911 | B1 | 10/2002 | Treusch et al. | |
| 6,601,564 | B1 | 8/2003 | Davey | |
| 6,637,408 | B1 | 10/2003 | Djordjevic | |
| 6,655,354 | B1 | 12/2003 | Curran et al. | |
| 6,745,798 | B1 | 6/2004 | Kilgore | |
| 6,807,944 | B1 | 10/2004 | Mizuno et al. | |
| 6,925,989 | B1 * | 8/2005 | Treusch et al. | 123/456 |
| 7,021,290 | B1 * | 4/2006 | Zdroik et al. | 123/456 |
| 2004/0216803 | A1 | 11/2004 | Kilgore | |

* cited by examiner

*Primary Examiner*—Thomas Moulis
(74) *Attorney, Agent, or Firm*—MacMillan, Sobanski & Todd, LLC

(57) ABSTRACT

The invention relates to a fuel charging system having pressure pulsation damping. The fuel charging system includes a first side rail connected to a second side rail by a crossover tube. Defined within the crossover tube are first and second passageways; the first passageway including a restricted flow section therein.

16 Claims, 4 Drawing Sheets

ENHANCED FUEL PRESSURE PULSATION DAMPING SYSTEM WITH LOW FLOW RESTRICTION

BACKGROUND

1. Field of Invention

The present invention relates generally to fuel charging systems for an internal combustion engine, and more particularly to fuel charging systems with reduced pulsation magnitudes at resonant modes of the fuel charging system.

2. Description of the Known Technology

Conventional methods of damping pressure pulsations in a fuel system rely solely on inclusion of a member that introduces more compliance, thereby reducing the bulk modulus of the system. This is often accomplished through the use of a flexible wall or walls in a member that is in liquid communication with the pulsating fuel to absorb the pressure fluctuations within the system.

However, a problem arises when the injector frequency excites one of the various resonant modes of the fuel system. At these frequencies, the maximum pressure pulsation magnitude can increase to several times normal operating levels. Attempting to resolve these resonant frequency issues simply by adding more compliance can result in other unwanted effects. Adding more compliance may allow more pulsations to be absorbed, but it will also result in a shift in resonant frequency. As compliance is increased, the resonant frequency modes shift to lower frequencies. When the modes shift lower, higher modes that were previously above the operating frequency range of the fuel system may shift into the operating frequency of the fuel system. Therefore, adding more compliance can sometimes result in more objectionable resonant frequency than before.

The solution to this problem, as shown in U.S. Pat. No. 6,848,477 to Treusch et al., includes one or more restrictors that work in conjunction with the system compliance dampers or inherent compliance to achieve the desired damping of pressure fluctuations. However, for fuel charging systems with dual-bank rail configurations, it may be found that when the engine is operating under heavy loads, an undesirable pressure difference between the two rails of a dual bank rail configuration may result. This pressure differential between the fuel rails causes different amounts of fuel to be injected into the two engine banks, altering the air/fuel ratio resulting in reduced fuel economy and emissions concerns.

Therefore, there is a need for a solution that introduces the desired damping of pressure fluctuations while minimizing the pressure differential between the fuel rails of a dual-bank rail configuration.

BRIEF SUMMARY

In overcoming the drawbacks and limitations of the known technology, the present invention provides fuel charging system with reduced pulsation magnitudes at resonant modes and reduced pressure differential between the fuel rails in a dual-bank rail configuration. More specifically, the fuel charging system having a fuel feed line, a first side rail having a passageway therein, the first side rail being connected to the fuel line, a second side rail having a passageway therein and a crossover tube connected to the first side rail and the second side rail. Within the crossover tube is a first passageway and a second passageway. The first passageway includes a restricted flow section. This restricted flow section may be a restrictor having an orifice or may be a reduced diameter passageway. The second passageway is unrestricted. Preferably, the crossover tube will connect to the first side rail and the second side rail while not extending into the first side rail or the second side rail. However, the crossover tube may extend into the first side rail and/or the second side rail.

The crossover tube may be one continuous member. However, the crossover tube made up first and second tubes, with the first tube having first and second passageways and the second tube also having first and second passageways. In such a construction, the first tube will be connected to the first side rail, the second tube will be connected to the second side rail, and the first and second tubes will be connected to each other. A restrictive flow section will be provided in at least one of the passageways of the first and second tubes. The restricted flow section may be a restrictor with an orifice or may be a reduced diameter section.

These and other advantages, features and embodiments of the invention will become apparent from the drawings, detailed description and claims, which follow.

DETAILED DESCRIPTION

Figure 1:
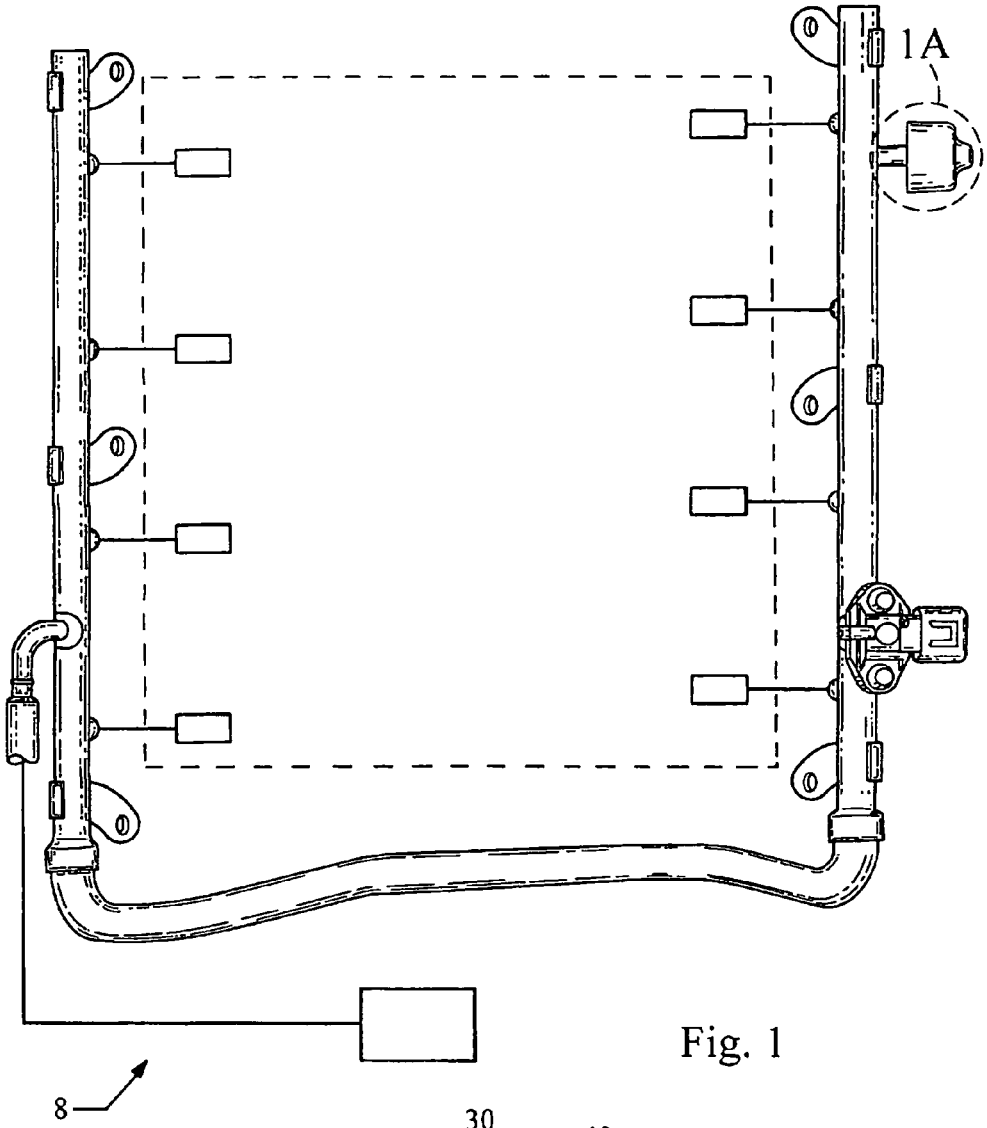
FIGS. 1 and 1A are views of a prior art fuel system with a conventional pulsation damper.
Figure 1A:
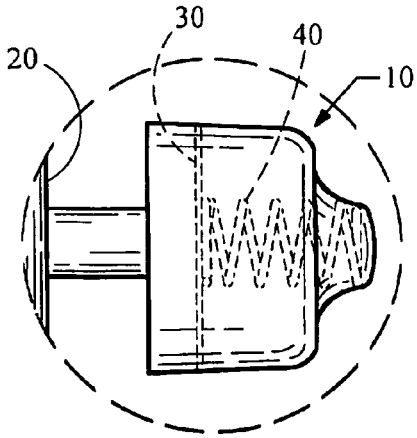

Referring now to FIGS. 1 and 1A, a fuel system 8 with a conventional pulsation damper is shown. Pressure pulsations in fuel systems result from inputs and outputs of the system. These pressure pulsations can add unwanted pressure fluctuations at the fuel injector, thus increasing injector flow variability and affecting the ability of the engine's powertrain control module to predict and control emissions and performance. In order to design an efficient powertrain control system, many automotive manufacturers will specify a maximum pulse magnitude that the fuel system should not operate beyond.

At particular loads within the operating range of the vehicle and fuel system 8, the fuel pressure pulsations can reach magnitudes in excess of ten times that experienced during other periods of operation. These large pressure pulsations in turn can create objectionable noise, vibration and harshness in the fuel system or exceed the specified maximum pressure pulse magnitude. Engineers thus need to develop systems that must operate in specific operational ranges with a design that avoids major pressure pulses in the system. These large pressure pulsations are dependent on and differ based on specific designs.

Often, dampers 10 will be added to dampen out the objectionable pulsations. The addition or modification of a damper 10 can alter the resonant modes of the system 8 however, sometimes moving a resonant mode that previously existed beyond the operating frequency range into the operating frequency range. Engineers can find themselves iteratively changing dampers 10 in an attempt to find the best compromise.

Pressure fluctuations in the fuel are put into the system 8 by the fuel pump, pressure release caused by firing injectors on the output side, and the interaction of these inputs and outputs among the elements of the fuel system 8. In a conventional system 8, the damper 10 is in fluid communication with the fluid passage 20 to absorb fuel pressure pulsations. In some systems, this damper can be as elementary as a thin wall in one of the fuel system components that flexes in response to pressure increases. In more complicated systems discrete dampers, such as the one illustrated, include a flexible diaphragm 30 is supported by a spring or other means 40 to absorb pulsation energy in the fluid passage 20. Still further examples of fuel systems include providing an internal damper in the fuel rail and providing the fuel rail/system with inherent or self-damping via the incorporation of flexible wall elements in the system.

As mentioned above, dampers are often developed and positioned in an iterative process with little regard to the interaction of the various components in how they function to reduce pressure fluctuations. Often more compliance elements are introduced in conventional systems to absorb energy and thus reduce the pulsations and their undesirable effects. However, more compliance in the system can create other problems such as shifting the resonant frequency to lower frequencies. When modes shift lower, higher modes that were previously above the operating frequency range of the fuel system may shift into the operating frequency of the fuel system. Therefore, adding compliance can sometimes result in more objectional resonant frequency than before. The present invention overcomes such problems.

Figure 2:
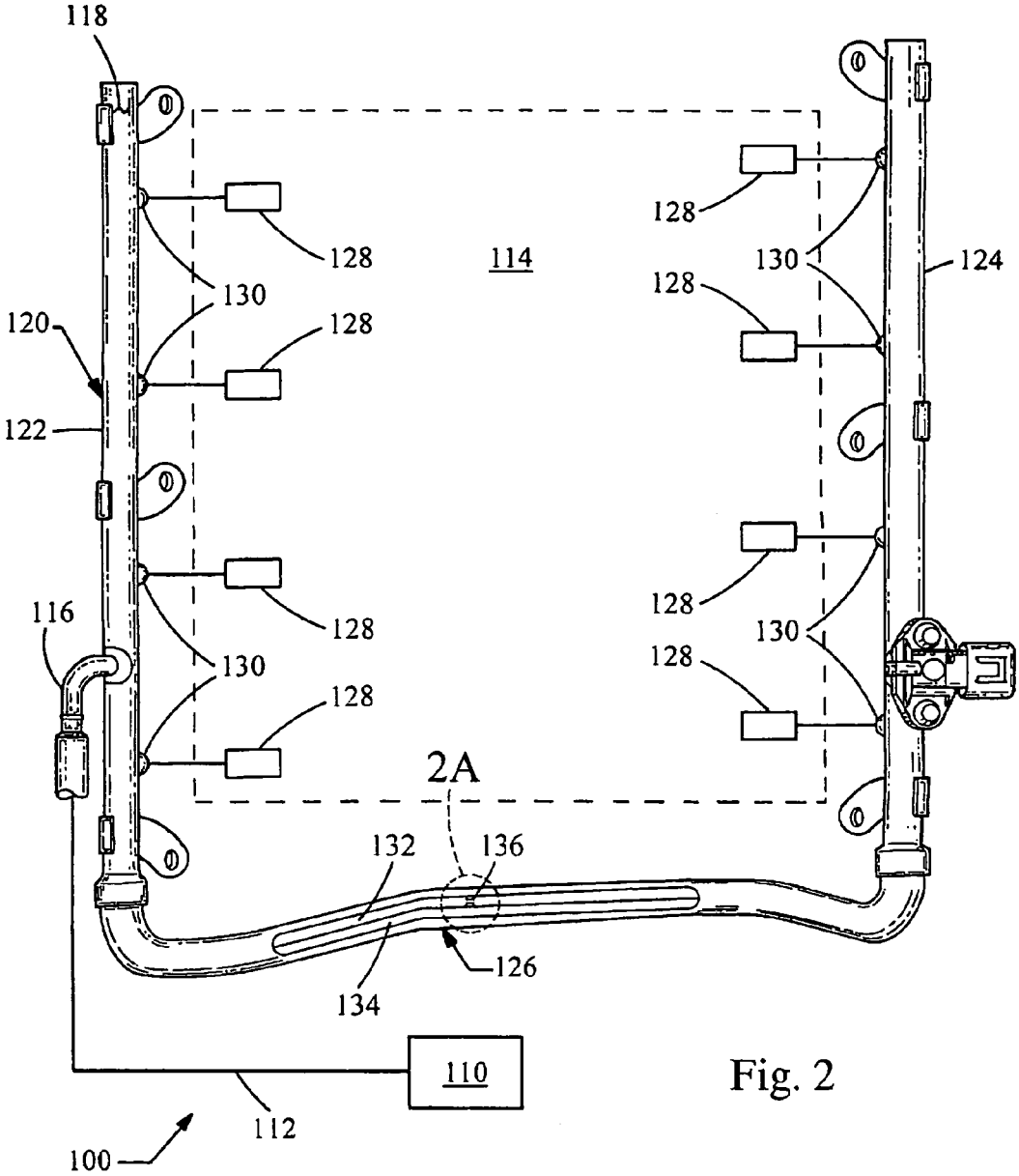
FIGS. 2 and 2A are views of the fuel system with a crossover tube embodying the principles of the present invention.
Figure 2A:
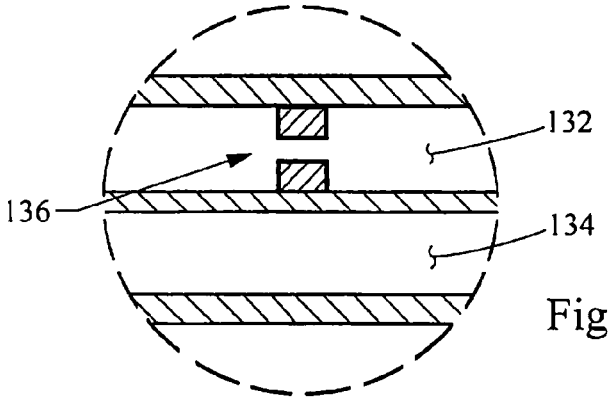

Referring now to FIG. 2 and FIG. 2A, a fuel system 100 is shown. The fuel system 100 provides fuel from a fuel tank 110, via a chassis line 112, to an internal combustion engine 114. From the chassis line 112, fuel is delivered via an inlet 116 into the internal passageway 118 of a fuel rail 120. The fuel rail 120 may be one of many known designs, such as the illustrated dual rail system having a first side rail 122 and a second side rail 124. The two side rails 122, 124 are connected by a crossover tube 126. Connected to the first and second side rails 122, 124 are a plurality of fuel injectors 128, connected via injector cups 130.

At least a portion of the crossover tube 126 includes a first passageway 132 and the second passageway 134. The first passageway 132 and the second passageway 134 run parallel to each other inside the crossover tube and are of substantially similar length. Preferably, the length of the first and second passageways 132, 134 is approximately 6–10 inches, but may be of any length suitable.

Figure 4A:
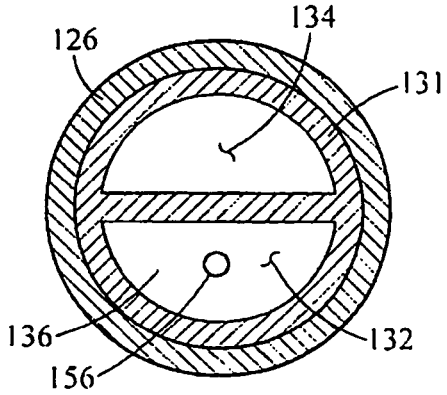
FIGS. 4A, 4B, and 4C are cross sectional views of various crossover tubes embodying the principles of the present invention.
Figure 4B:
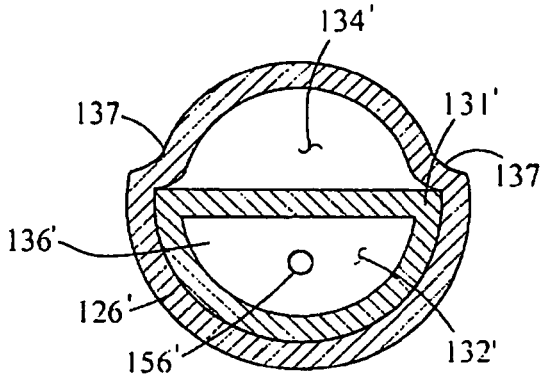
Figure 4C:
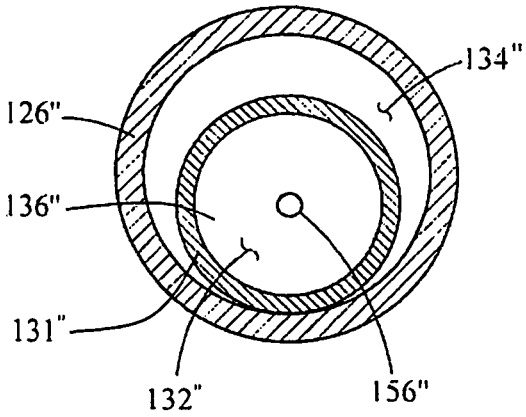

Inside the first passageway 132 is a restrictor 136. The restrictor 136 may be placed anywhere within the first passageway 132. The restrictor 136 includes an orifice (as best shown in FIGS. 4A, 4B and 4C as orifice 156, 156' and 156" respectively).

Figure 3:
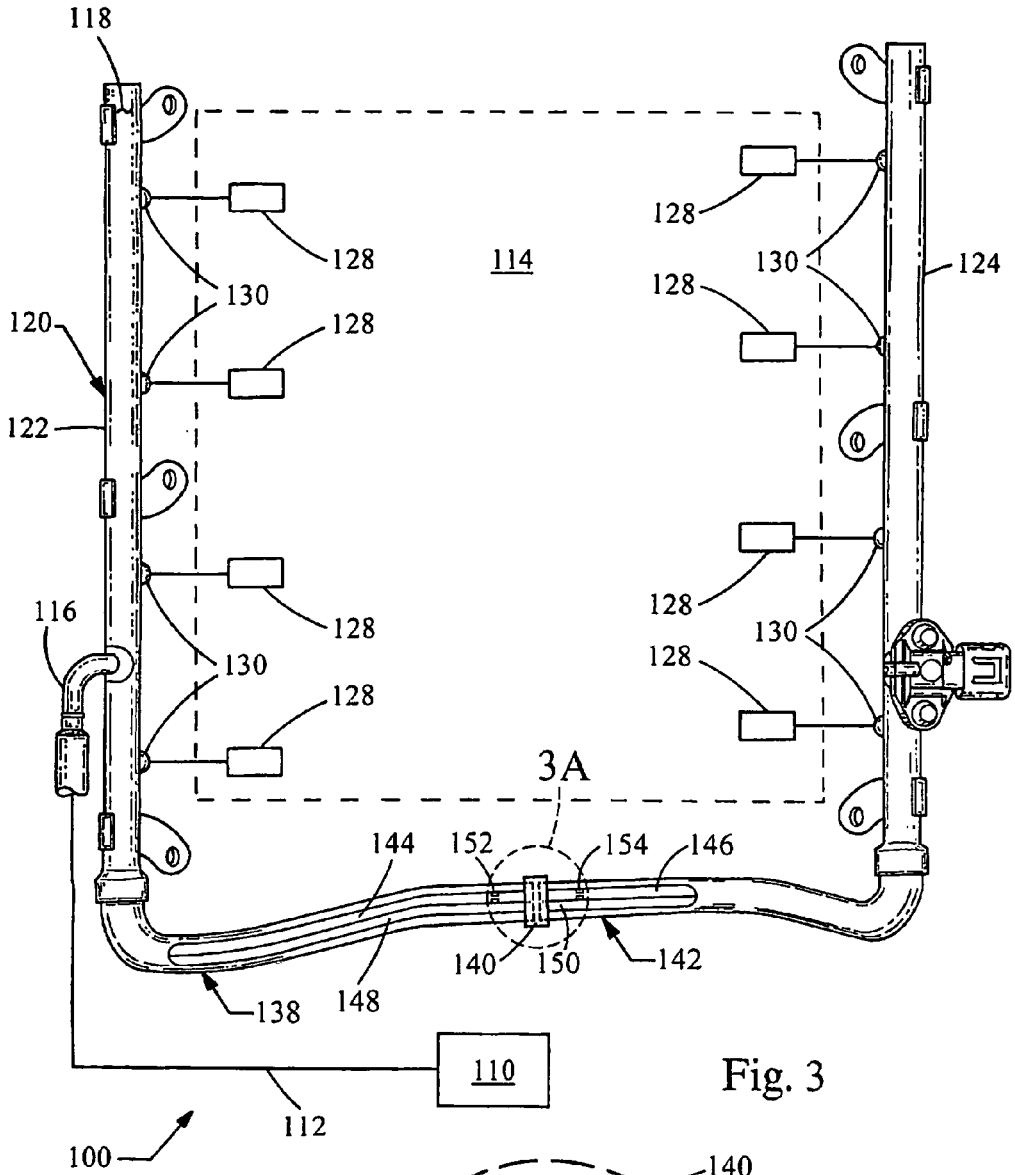
FIGS. 3 and 3A are views of the fuel system with a first and second crossover tubes and embodying the principles of the present invention.
Figure 3A:
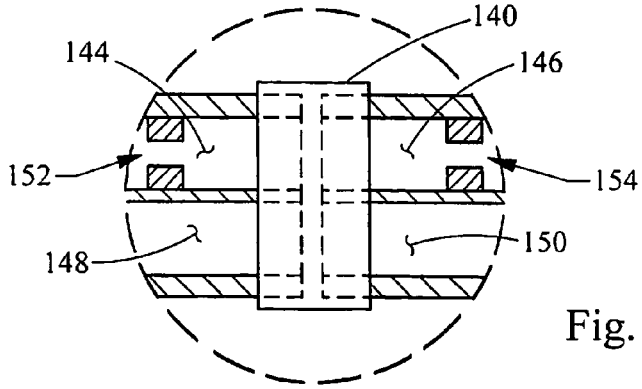

Manufacturing and packaging limitations may dictate the need for joining two crossover tubes at their ends to achieve a longer crossover tube. Referring now to FIG. 3 and FIG. 3A, the crossover tube 126 of FIG. 2 has been replaced with a first crossover tube 138 and a second crossover tube 142 connected together by a joining member 140. The first crossover tube 138 is connected to the first siderail 122 and the joining member 140. The crossover tubes 138, 142 are preferably coupled to the joining member 140 through a brazing process. The second crossover tube 142 is connected to the second side rail 124 and the joining member 140. The first crossover tube 138 and second crossover tube 142 both have first passageways 144, 146 and second passageways 148, 150.

As shown in FIG. 3, first passageways 144, 146 have restrictors 152, 154 placed within these passageways. Alternatively, the first restrictor 152 and the second restrictor 154 may be placed in the second passageways 148, 150. As a further alternative, the first and the second restrictors 152, 154 may be formed as reduced diameter passageways.

Although FIGS. 2 and 3 show the crossover tube 126 and the first and second crossover tubes 138, 142 not extending into the first and/or second side rails 122, 124, the crossover tube 126 and the first and second crossover tubes 138, 142 may extend into the first and/or second side rails 122, 124.

Referring now to FIG. 4A, a cross section of the crossover tube 126 is shown. Within the crossover tube 126 is a sleeve 131. The sleeve 131 is located within the crossover tube 126 and defines the first passageway 132 and the second passageway 134. The sleeve 131 may be held in place within the crossover tube 126 by friction, by an adhesive or other suitable means. Within the first passageway 132 is a restrictor 136 having an orifice 156. The orifice 156 preferably has a diameter of 0.8 mm, but may have a diameter ranging from about 0.6 mm to about 1 mm.

Alternatively, as shown in FIG. 4B, a half sleeve 131' may be placed into the crossover tube 126' and held in place by the previously mentioned means or by crimping the crossover tube 126', at 137 for example, such that the half sleeve 131' is frictionally held in place. The half sleeve 131' defines a first passageway 132'. A second passageway 134' is therefore defined within the crossover tube 126' by the remaining portion of the crossover tube 126' that is not occupied by the half sleeve 131'. The first passageway 132' includes a restrictor 136' with an orifice 156' of a diameter of about 0.8 mm but may have a diameter ranging from about 0.6 mm to about 1 mm.

In a further embodiment shown in FIG. 4C, a crossover tube 126" contains a sleeve 131". The restrictor tube defines a first passageway 132". A second passageway 134" is therefore defined within the crossover tube 126" by the remaining portion of the crossover tube 126" that is not occupied by the restrictor tube 136". The first passageway 132" includes a restrictor 136" with an orifice 156" of a diameter of about 0.8 mm but may have a diameter ranging from about 0.6 mm to about 1 mm.

The foregoing discussion discloses and describes a preferred embodiment of the invention. One skilled in the art will readily recognize from such discussion, and from the accompanying drawings and claims, that changes and modifications can be made to the invention without departing from the true spirit and fair scope of the invention as defined in the following claims.

We claim:

1. A fuel charging system for an internal combustion engine comprising:

a first side rail defining a fuel passageway therein, the first side rail being connected to the fuel line;

a second side rail defining a fuel passageway therein;

a crossover tube connecting to the first side rail to the second side rail, a portion of the crossover tube defining a first passageway and a second passageway therein; and portions of the first passageway defining a restricted flow section having a reduced cross sectional area relative to other portions of the first passageway.

2. The fuel charging system of claim 1, wherein the restricted flow section includes a restrictor having an orifice therein.

3. The fuel charging system of claim 2, wherein the orifice has a diameter from about 0.6 mm to about 1 mm.

4. The fuel charging system of claim 2, wherein the orifice has a diameter of about 0.8 mm.

5. The fuel charging system of claim 1, wherein the restricted flow section is a reduced diameter passageway having a diameter less than a remainder of the first passageway of the crossover tube.

6. The fuel charging system of claim 5, wherein the reduced diameter is a diameter from about 0.6 mm to about 1 mm.

7. The fuel charging system of claim 5, wherein the reduced diameter is about 0.8 mm.

8. The fuel charging system of claim 1, wherein the portion of the crossover tube has a length of about 6 to 10 inches.

9. The fuel charging system of claim 1, wherein the portion of the crossover tube is about 8 inches in length.

10. A fuel charging system for an internal combustion engine, the system having fuel pressure pulsation damping and comprising:

a first side rail defining a fuel passageway therein, the first side rail being connected to the fuel line;

a second side rail defining a fuel passageway therein;

a first crossover tube connected to the first side rail, the first crossover tube having a first and second passageways therein;

a second crossover tube connected between the second side rail, and the first crossover tube, the second crossover tube having first and a second passageways; and a restricted flow section defined in at least one of the first passageway of the first crossover tube, the second passageway of the first crossover tube, the first passageway of the second crossover tube and the second passageway of the second crossover tube.

11. The fuel charging system of claim 10, wherein the restricted flow section includes a restrictor having an orifice defined therein.

12. The fuel charging system of claim 11, wherein the orifice has a diameter from about 0.6 mm to about 1 mm.

13. The fuel charging system of claim 11, wherein the orifice has a diameter of about 0.8 mm.

14. The fuel charging system of claim 10, wherein the restricted flow section is a length of reduced diameter passageway.

15. The fuel charging system of claim 14, wherein the reduced diameter is a diameter from about 0.6 mm to about 1 mm.

16. The fuel charging system of claim 14, wherein the reduced diameter is about 0.8 mm.

* * * * *